US006233859B1

(12) United States Patent
Kilpatrick et al.

(10) Patent No.: US 6,233,859 B1
(45) Date of Patent: May 22, 2001

(54) DISPLAY HOLDER

(76) Inventors: Gary Samuel Kilpatrick, 18 Birchmore Green, Woburn, MK17 9HU (GB); James Cox, 50 Orendaal Road, Aurora, Durbanville 77550, Cape Province; Michael George Robson, 50 Reservoir Road, Somerset West 7130, Cape Province, both of (ZA)

( * ) Notice: Subject to any disclaimer, the term of this patent is extended or adjusted under 35 U.S.C. 154(b) by 0 days.

(21) Appl. No.: 09/202,554

(22) PCT Filed: Jun. 18, 1997

(86) PCT No.: PCT/GB97/01656

§ 371 Date: Mar. 24, 1999

§ 102(e) Date: Mar. 24, 1999

(87) PCT Pub. No.: WO97/49078

PCT Pub. Date: Dec. 24, 1997

(30) Foreign Application Priority Data

Jun. 18, 1996 (GB) ..... 9612731

(51) Int. Cl.[7] ..... A47G 1/06

(52) U.S. Cl. ..... 40/790; 40/791; 40/793; 40/794; 40/796; 24/67.3

(58) Field of Search ..... 40/790, 791, 792, 40/793, 794, 796, 782; 24/327, 494, 498, 67.7, 67.3

(56) References Cited

U.S. PATENT DOCUMENTS 3,310,901 * 3/1967 Sarkisian ..... 40/793
4,438,578 * 3/1984 Logan ..... 40/782
4,498,255 * 2/1985 Heard ..... 40/793
4,702,025 * 10/1987 Mace ..... 40/793
5,159,770 * 11/1992 Yamaguchi ..... 40/790
5,307,575 * 5/1994 Ivansson et al. ..... 40/793
5,364,057 * 11/1994 Pynenburg ..... 24/67.3
5,396,722 * 3/1995 Ostrovsky ..... 40/796
5,692,333 * 12/1997 McClave ..... 40/792 X

FOREIGN PATENT DOCUMENTS

19524535 * 1/1997 (DE) .
0383041 * 1/1990 (EP) .
0457987 * 9/1990 (EP) .
2289623 * 11/1995 (GB) .

* cited by examiner

*Primary Examiner*—Terry Lee Melius
*Assistant Examiner*—James M Hewitt
(74) *Attorney, Agent, or Firm*—Robert D. Buyan; Stout, Uxa, Buyan & Mullins, LLP

(57) ABSTRACT

A frame element assembly suitable for forming the frame of a display holder, the frame element assembly having a base portion and a retaining leaf, the retaining leaf being pivotally mounted with respect to the base portion, the retaining leaf being held in a pivotal arrangement by a bow spring, the assembly being adapted such that in use the retaining leaf can pivot between an "open" position in which display material can be inserted or removed from the display holder and a "closed" position in which display material is retained within the display holder. The assembly is adapted such that the retaining leaf is removably mounted with respect to the pivot arrangement when the display holder is in its assembled state.

20 Claims, 3 Drawing Sheets

FIG. 1
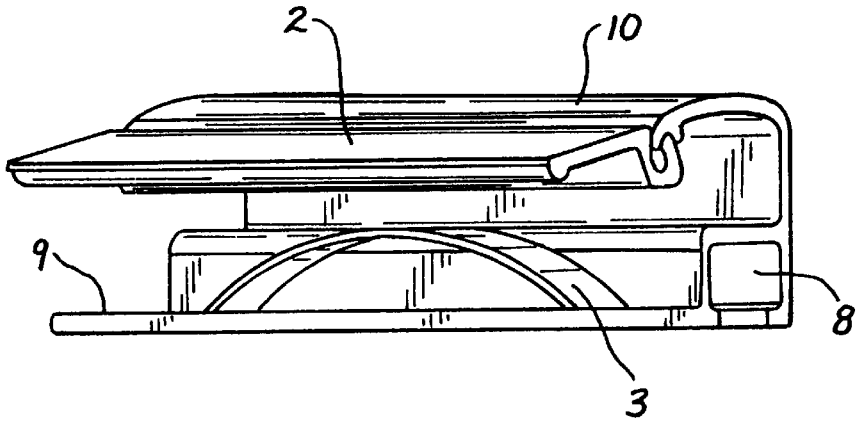
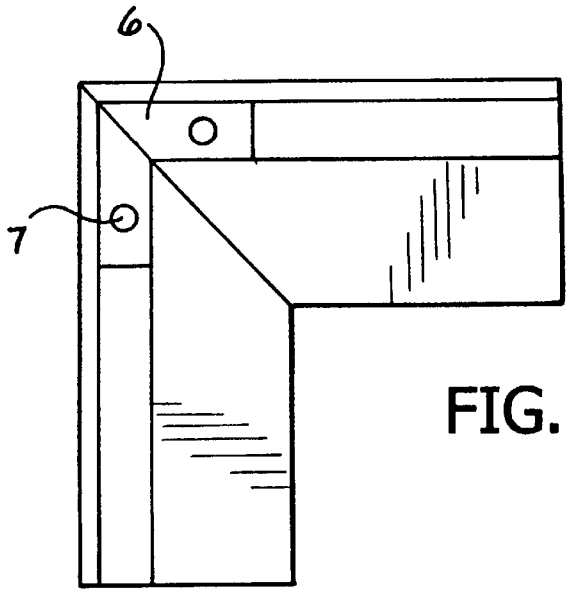
FIG. 2
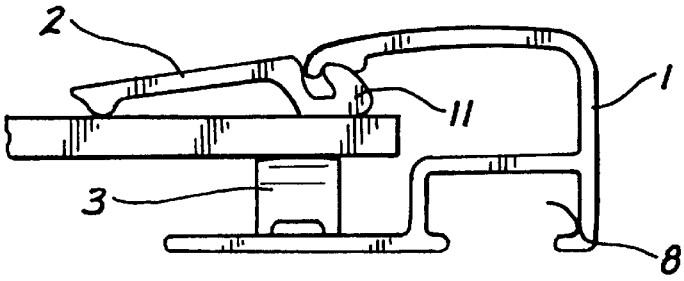
FIG. 3

FIG. 4
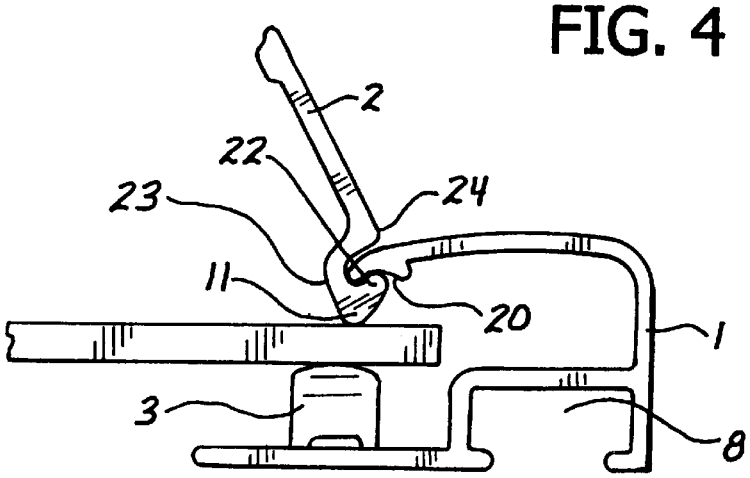
FIG. 5
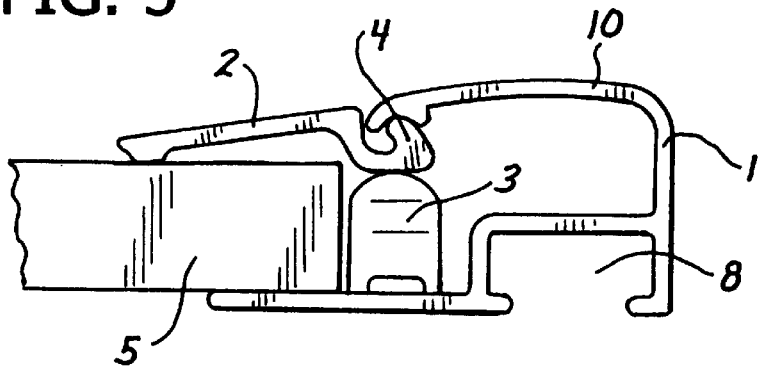
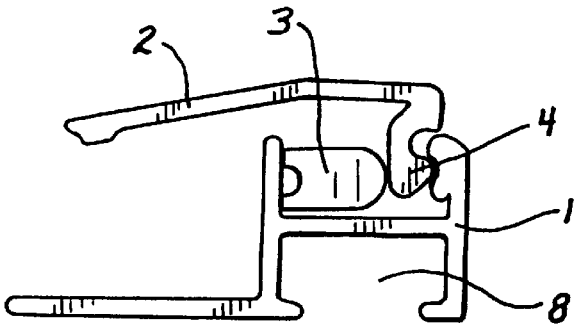
FIG. 6

FIG. 7
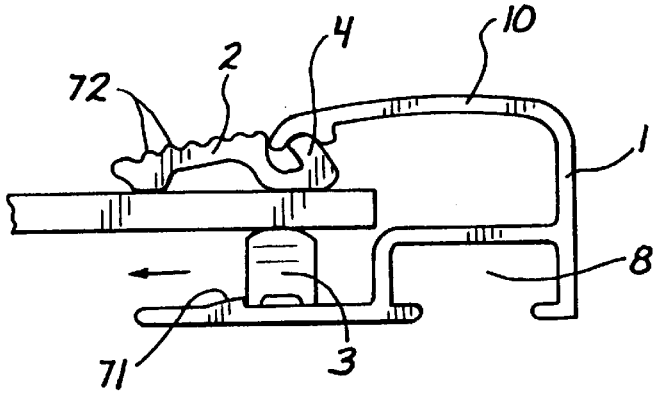
FIG. 8
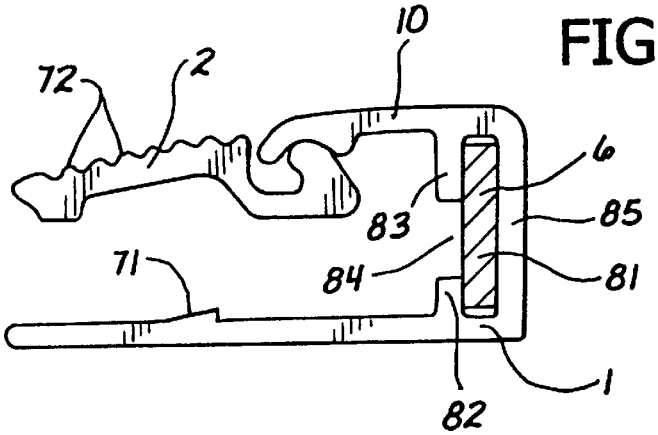
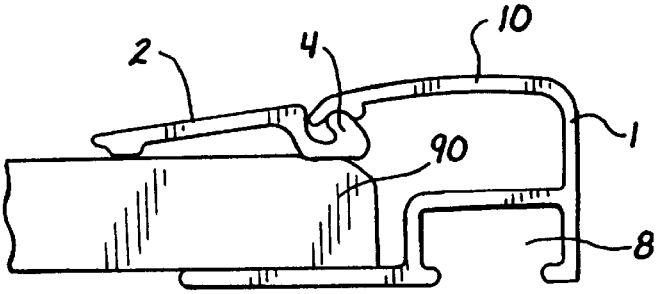
FIG. 9

DISPLAY HOLDER

FIELD OF INVENTION

This invention relates to a frame element assembly for use in the construction of display holders. Such display holders are typically used for the presentation of posters and similar advertising material.

BACKGROUND OF THE INVENTION

Display holders are used in many different places where it is desired to display information. For example, on building walls such as in car show rooms, and in supermarkets and other shops. The holders can also be placed on posts or on stands, for example on garage forecourts, and can be used in vehicles such as trains, buses, and taxi cabs. The display holders can be used both indoors and outdoors.

One requirement for these display holders is that they must be able to secure the display material firmly and securely and be robust. That is, the holders must be able to withstand movements, for example, from the motion of a train, from the wind or from casual handling. The display holders must also protect the display material from the weather and from any other dirt or dust in the environment as well as being weather-proof themselves.

Another requirement for the holders is that they must be easy and quick to assemble and to mount onto a support such as a wall or post. This is especially important for advertising displays where it is important to minimize the costs of assembling the frame and fixing the frame to a support in the desired location.

It is also necessary to be able to quickly and easily change or replace the display material in the holder, for example when new advertising material is being changed or updated. One problem with known display holders is that it may be difficult to do this. For example, the user needs to guard against getting his or her fingers trapped in the holder mechanism and must carefully hold the frame whilst replacing the display material.

Equally importantly, the moveable portion of a frame used to clip or hold the display portion in place, generally known as a retaining leaf, may get damaged in use and it then becomes necessary to replace it. Alternatively, different artwork may require a different color finish to the clip. In both these cases it is desirable to be able to replace the clip or retaining portion without dismantling the frame. This feature is not generally provided by prior art display holders.

Display holders are known per se. For example, U.S. Pat. No. 3,301,901 (Sarkisian) describes a two-part frame element with the two parts, a base portion and a clamping element, held under tension by a complex-shaped leaf spring. GB 2 005 535 (Marketing Displays Inc) describes an improvement to U.S. Pat. No. 3,301,901 in which the spring is replaced by a simple leaf spring. However, in neither case can the moveable clamping element be replaced without dismantling the entire frame.

Similarly U.S. Pat. No. 4,498,255 (Heard) and U.S. Pat. No. 4,702,025 (Mace) describe further variations on this two-part construction theme. In both cases the two components must be assembled by sliding the parts together along their respective longitudinal axes. This form of construction also precludes replacement once the frame has been assembled.

U.S. Pat. No. 5,396,722 (Oszrovsky) describes a frame element in which a base member a clip support member and a clip are either glued together or co-extruded Whilst this latter prior art provides a visually appealing "frame within a frame" appearance it is difficult to construct and repair. A two part frame is described in U.S. Pat. No. 5,364,057 (Pynenburg) which is the closest prior art known to the applicant. Another disadvantage with known display holders is that they are only capable of holding display material with a certain pre-determined thickness or range of thicknesses. This is problematic if it is desired to use display material that is formed on thick board as well as paper, for example. It may also be necessary to place an additional water-proof transparent cover over the display material and this can also increases the thickness of the display material.

The known display holders also require a back panel (for example, fluted polypropylene material) to the frame against which the display material is held. This back panel is problematic because it further limits the space which the display material can occupy and is an extra part which must be supplied and transported to the site. Furthermore, where the back panels are not retained by positive fixings this means that they can be lost in strong winds so rendering the frame useless. A further disadvantage is that in known display holders the user often traps his or her fingers between the movable part of the frame and the artwork. The frames typically close in a snap-action fashion which can be very rapid. Also there is a danger that the springs may pop-out of the display holder as the display material is being replaced. This can be very dangerous because the springs are sharp and may fly out of the display holder at some speed. Also, it is difficult to replace the springs into the display holder.

It is accordingly an object of the present invention to provide a display holder suitable for presenting posters and similar advertising material which overcomes or at least mitigates some or all of the problems noted above.

SUMMARY OF INVENTION

According to a first aspect of the present invention there is provided a frame element assembly suitable for forming the frame of a display holder, said frame element assembly comprising a base portion and a retaining leaf, the retaining leaf being pivotally mounted in use with respect to the base portion, the retaining leaf being held in said pivotal arrangement by a resilient biasing means, the assembly being adapted such that, in use, the retaining leaf can pivot between an "open" position in which display material can be inserted or removed from the display holder and a "closed" position in which display material is retained within the display holder, characterized in that the assembly is further adapted such that the retaining leaf is demountably mounted with respect to the base portion when the display holder is in its assembled state. This arrangement has the advantage that the retaining leaf can be inserted after the outer or base frame of the display holder has been put together. This simplifies the mechanics of assembly considerably and also enables a retaining leaf to be replaced without dismantling the display holder frame.

In a particular preferred embodiment the resilient biasing means acts directly on the retaining leaf in the region of the pivot. In addition to facilitating the primary invention this has the advantage over the prior art that the resilient biasing means does not have to engage in channels in both frame elements.

Preferably the resilient biasing means acts directly on the retaining leaf through a backing board to the display material. This arrangement has the advantage that the load exerted by the biasing means is spread along the entire length of the retaining leaf.

Preferably the resilient biasing means comprises a bow spring, both ends of the bow engaging with the base portion. Bow springs are cheap, simple and effective. Depressing the bow spring enables back boards of various thicknesses to be inserted between the spring and the retaining leaf.

In a further particularly preferred embodiment the assembly is further adapted such that when the retaining leaf is in the substantially closed position the leaf may be depressed against the resilient biasing means in a direction substantially towards the display material in order to disengage the retaining leaf from the back portion. This arrangement provides for the simplest assembly/disassembly procedure.

Alternatively, the assembly is further adapted such that when the retaining leaf is in the substantially closed position the leaf may be depressed against the resilient biasing means in a direction substantially parallel to and towards the center of the display material in order to disengage the retaining leaf from the back portion. This arrangement provides a particularly compact frame.

Preferably the retaining portion incorporates a protrusion which interacts with the resilient biasing means such that when the retaining portion is opened or closed in use an over-center action tends to urge the retaining leaf into either the open or closed configuration. This over-center action gives the frame a positive feel and urges the retaining leaf onto the display material when it is in the closed position.

In the preferred embodiments the retaining portion forms a "frame within a frame" surround to the display material. This enhances the aesthetic appeal of the frame especially if the base portion and retaining leaf are finished in different colours.

Particularly preferably the resilient biasing means is retained within a channel or detained by a lug formed in the base portion. This prevents the biasing means moving away from the pivot region and especially prevents it flying out accidentally.

Preferably the resilient biasing means is retained within the base portion without the necessity of the retaining leaf being present, such that on removal of the retaining leaf in use the resilient biasing means remains captive within the base portion. This aids assembly and disassembly.

Preferably the assembly is adapted to accommodate a display material backing board between the resilient biasing means and the retaining leaf.

Preferably the assembly further comprises a bracing channel within the base portion and a corner brace adapted to be an engaging fit within the brace channel.

In a particularly preferred embodiment the base of the bracing channel is aligned with the outer side edge of the base portion. This enables the overall depth of the display frame to be reduced.

In a further preferred embodiment the front of said channel is deformable against said corner brace in order to retain said corner brace in place. This avoids the necessity to use screws to keep the brace in place. Generally these frame elements are extruded from aluminium or aluminium alloy which is easily deformed.

In a further preferred embodiment the corner brace comprises a serrated surface, said serrations serving to retain the corner brace within the brace channel in use. If the, serrations are angled away from the direction in which the brace enters the channel this eases entry whilst ensuring that the teeth bite to prevent withdrawal.

The invention extends to include a display holder comprising a plurality of frame element assemblies connected together to form a polygonal-shaped holder.

DESCRIPTION OF THE DRAWINGS

The invention will be further described, by way of example only, with reference to the accompanying drawings in which:

FIG. 1 shows a perspective view of part of a frame element assembly according to a first embodiment of the invention;

FIG. 2 shows a plan view of a corner of a display holder from the back;

FIG. 3 shows a cross-section through a frame element assembly in a closed configuration, including a sheet of board, FIG. 4 shows a cross-section through the frame element assembly of FIG. 3 in an open configuration;

FIG. 5 shows a cross-section through a frame element assembly in a closed configuration including a thick sheet of board;

FIG. 6 shows a cross-section through a second embodiment of a frame element assembly;

FIG. 7 shows a cross-section through a further frame element assembly;

FIG. 8 shows a cross-section through a further embodiment incorporating a corner brace, FIG. 9 shows a cross-section through a further embodiment incorporating compressed foam board.

DESCRIPTION OF PREFERRED EMBODIMENTS

Embodiments of the present invention are described below by way of example only. These examples represent the best ways of putting the invention into practice that are currently known to the Applicant although they are not the only ways in which this could be achieved.

Referring first to FIGS. 1 and 5, a frame element assembly consists of essentially three components a base or back portion 1, a retaining leaf or front portion 2, and a resilient biasing means in the form of a bow spring 3. A display holder is formed by cutting the front and back portions to the required lengths and joining them together, preferably with mitred joints, to make a frame one corner of such a frame being shown in FIG. 2. The front and back portions are pivotally mounted with respect to each other, pivoting about the radiused lug 4 which runs the length of the extrusion as shown in FIG. 5 with the bow spring 3 acting on this pivot arrangement. By this means the front portion 2, can be either opened as shown in FIG. 4 or closed as shown in FIG. 3. In the open configuration display material and/or backing board 5 can be easily put into or taken out of the holder from the front.

To form the frame outline, front and back portions are cut to the required lengths and mitred at 45°. The ends of the portions are then abutted as shown in FIG. 2 and joined using L-shaped braces 6 which are fixed using screws 7 although any other conventional fixing means could be used. Alternative fixing arrangements are described below. The braces 6 are accommodated within a recessed channel 8 in the base portion. Using this method, frames of any polygonal shape can be formed. Also, it is possible for each of the front or back portions to be made up from a number of pieces of shorter lengths. Once the frame has been assembled the springs can be inserted. Thus the display holder can be provided in kit form, so reducing transportation and storage costs.

It will be appreciated that this form of construction enables the springs to be inserted directly into the base portion and to remain in situ without the retaining leaf being present. The retaining leaf 2 can be inserted simply by using it to depress the springs, which extend slightly beyond the front face of the base, and sliding it under the upper surface of the base member until the elements of the pivot engage. There is no need to slide the respective components together, as required in the prior art.

The shape and configuration of the pivot region is important. In the prior art cited above the pivot function tends to be a true hinge provided by a ball and socket joint. The socket extends around more than half the circumference of the ball. This means that during assembly the components of the prior art have to be cut to length then slid one within the other until their respective ends coincide.

In the present invention a round-bottomed channel 20 is formed in the base portion. The mouth of this channel is its widest part which is to say the channel is generally dish-shaped or concave. A radiused or convex-shaped lug or protrusion 22 is provided along the length of the retaining leaf and in use, this lug simply nests within the channel 20. This arrangement allows the retaining leaf to undergo a general rotational movement with respect to the base member from a closed configuration (FIG. 3) to an open configuration (FIG. 4) and vice versa.

The extent of closure is limited by the planar face 23 contacting the top of the spring or the display material as shown in FIG. 3. The extent of opening is limited by surface 24 contacting the front of the base portion.

This may not be regarded as pivotal movement in its strictest sense because the retaining leaf lug 22 tends to move across the channel during the opening and closing process. In fact, all that is required of this mechanism to operate is that the retaining leaf can rotate through approximately 90° of arc. How this is achieved providing the two components can be separated in the way described is immaterial. The display holder can be easily and quickly fixed to a support such as a wall, post or display stand. This can be achieved in several ways. For example, the back portions 1 can be screwed directly to the wall. This can be done by holding the back portion against the wall (with the front portions either not attached or in the open position) and drilling straight through the back portion into the wall. A Rawplug (TM) or conventional wall fixing can then be inserted followed by a screw. This is done at locations in-between the springs for example, at 9 in FIG. 1 so that the screw heads are not in the way of the display material or backing boards. Alternatively the display holder can be fixed to a support using known security fastenings which are held within the recess 8 in the back portion. Another possibility is to use double sided sticky-tape or other conventional adhesives to stick the back of the frame to the support. This is particularly effective when the display material and backing board is constructed from light-weight material such as polystyrene and paper. It is also possible to hang the frame onto hooks provided on the support using the recess 8. For example, nails or other conventional picture hooks can be used. The display holders can also be used as lids for light boxes. The front opening ability permits easy access to the box for quick replacement of tubes, starters or fuses. Also the holder allows material to be held on top of the light box.

The term resilient biasing means in the context of this invention is intended to encompass any material or structure which can create a biasing force to hold the pivot arrangement together and allow the necessary movement of the retaining leaf with respect to the base portion. In a preferred embodiment the resilient means is provided by a bow spring made from a good grade of spring steel as shown in FIG. 1. However, it is equally possible to use a helical spring, or any piece of material which will give as the joint 4 is opened and will tend to push back against that joint. For example, a piece of compressed foam board 90, or polystyrene would suffice. The important feature of the resilient means is its ability to exert a biasing force on the pivot arrangement.

During construction of a display holder, one or more springs 3 are positioned in each section of the frame between the front and back portions. The springs 3 bias the front and back portions relative to one another and act to maintain a snug mating pivotal engagement of portions 1 and 2. This is shown in FIG. 5 where the front and back portions are adapted to pivot around protrusion 4. The springs 3 also exert sufficient friction against the front portion to resist any longitudinal shift of the back portion at the hinge assembly.

One of the advantages of this arrangement is that additional springs can be inserted even after the out frame or base portion has been put together. It is therefore possible to adjust the tension within the assembly at any time to suit a particular application.

In the context of the present invention the terms "pivot", "pivotal arrangement" and "pivotally mounted" have a broad meaning. They are not intended to be restricted to arrangements which include a true pivot pin or pivot point or even to arrangements in which rotation takes place around a notional pivot point. These terms are instead intended to include any arrangement which permits or enables angular rotation of the retaining leaf, with or without lateral displacement of the two components.

In the closed configuration the front portion 2 is biased against the display material 5 as shown in FIG. 5, or against the display material and board as shown in FIG. 3. The springs 3 also act to hold the front portion in an open configuration for removal or replacement of the poster. In order to insert the display material, the front portions of the frame are opened and the material simply loaded into the front of the frame. The front portions are then closed. This can be done easily and quickly either in situ or before the frame has been attached to a support.

As shown in FIG. 3 the front portion is designed with a shoulder 11. The front portion moves against the back portion with a lever action against bow spring 3. The shoulder 11 creates an over-center action as the front portion is moved between the open and closed configurations. In the closed configuration as shown in FIG. 3 the shoulder lies flat against the spring 3 and in the open configuration the tip of the shoulder pushes down onto the spring as shown in FIG. 4. These represent two stable positions for the front portion, with the intermediate positions being unstable. This means that as the front portion is moved it tends to fall into either the open or closed position so producing a positive snap-action. One advantage of this arrangement is that as the retaining leaf is closed the shoulder 11 automatically tensions the display material to keep it flat.

If display material is used that is slightly thicker than the depth between the front portion and the back portion in the closed configuration, then the front portion 2 is forced up a little. Because of the over center action of the shoulder the front portion 2 is still biased onto the display material and holds this in place. This gives the advantage that display material that is slightly thicker than display material 5 as shown in FIG. 5 can be used.

In a preferred embodiment the front portion 2 forms an inner frame around the display material with the outer frame being provided by the top part of the base portion 10 as shown in FIG. 5. However, the term front portion also encompasses situations as illustrated in FIG. 6. Here the pivot arrangement 4 is positioned on the side of the display holder so that there is no inner and outer frame as such. The preferred embodiment as shown in FIG. 5 is advantageous in that extra support is provided for the display material. Also a two-tone effect can be achieved by giving the inner and outer frames different colours.

It will be appreciated that the front portion 2 is interchangeable in situ, for all the embodiments described. This allows for a "change of image" with a minimum of fuss and cost.

In an alternative embodiment a board can be inserted between the resilient means and the front portion. This is shown in FIGS. 3 and 4. This has the advantage that the load from the springs 3 is spread over the board and acts against the pivot arrangement along its entire length. Also, the board helps to retain the springs in position. Any tendency for the front portion to work the spring out from its position during the opening and closing action is reduced. With the board in place as shown display material is inserted on top of the board.

The board may be inserted during assembly of the frame. One side of the frame is simply left open so that the board can be slid down into position and then the frame is closed by putting the final side in place. Any conventional board such as hard board can be used. Alternatively, since the springs can be inserted as the last step from the back of the frame then a flexible board could be maneuvered into position even after the frame has been assembled.

The front and back portions of the frame are preferably manufactured using an extrusion process. For example, they can be manufactured from aluminium and can be given an attractive external appearance which is durable and can be used both indoors and outdoors. These frames can be presented using anodised colours, both matt and bright finishes and also with a full range of powder coated paint finishes. They may also be plated.

The frame can also be made from plastics materials, wood or other such materials. This is a significant advantage over the prior art for which softer materials like plastic and wood are not viable. Prior art display holders which use a leaf spring that slides between two sides of a channel cannot be made from softer material. In these cases, the steel spring causes damage to any channel that is made from plastic, for example. In the present invention, the sharp edges of the spring do not move against the frame so that softer materials such as plastic can be used. In the case of plastics, the frame parts can be manufactured using an extrusion or other suitable process. Also, wooden frames can be made by turning the wood to form the desired shape.

This provides further advantages, in that the frames are cheaper to produce and are lighter. Lightweight frames are easier to transport, assemble and display. Plastic frames may also be used outdoors without the need to plate or anodize the surface and these frames can be easily manufactured in a wide range of colours.

One particular advantage of the invention is that it allows a wide range of thicknesses of display material to be used. For example, in one embodiment display material from 0.5 mm to 12 mm can be accommodated in the holder. The front and back portions can be suppiled in 3.08 m lengths which gives a 3 m square capacity. However, these examples do not limit the invention. Many other dimensions can be used.

A further embodiment is shown in FIG. 7. Here the retaining leaf 2 has ridges 72 in its upper surface as shown. This makes the retaining leaf easier to manufacture using an extrusion process which reduces costs. Also the aesthetic appearance of the frame is enhanced. A protrusion 71 can also, be incorporated into the backing portion 1 as shown in FIG. 7. This protrusion 71 is formed during the extrusion process and acts to retain the spring 3 in place during opening and closing of the frame. The natural motion of the retaining leaf would tend to cause the spring shift in the direction arrowed. FIG. 7 shows this embodiment in use with a backing board placed over the spring 3 as in FIG. 3. However, it is also possible to use the arrangement of the spring as shown in FIG. 5, with the embodiment shown in FIG. 7. As already mentioned, a recessed section 8 in the back portion of the frame is provided to accommodate braces 6 which are used to join lengths of frame together. As shown in FIGS. 3, 4, 5 and 7 the presence of the recess 8 effectively increases the required width of the top part of the backing portion 10. This increases the width and the depth of the frame and reduces the area of display within the frame.

One possible way of overcoming this problem is shown in FIG. 8. This involves positioning the brace 6 along the inside end wall 85 of the backing portion 1. By doing this the width of the top part of the base portion 10 can be reduced as shown. The brace 6 is inserted into the backing portion 1 and arranged to span between two lengths of frame. Instead of using screws to hold the brace in place, and thus the two lengths of frame together, it is possible to press the protrusions 83 and 82 against the brace to hold it in position. This method of cleating to form the joint by pressing the protrusions 83 and 82 against the back wall 85 of the backing portion 10 is a useful alternative to other fixing methods. However, it is also possible to use any other conventional fixing means to fix the brace 6 in place.

In an alternative arrangement (not shown) the brace can have a serrated edge or edges. The serrations can be angled away from the direction in which the brace is inserted. Thus it is relatively easy to drive the brace home into the recess but any attempt to withdraw the brace causes all the serrations to engage the surrounding extrusion.

The assembly instructions can be summarized as follows:

a) cut and assemble the four sides of the base portion, joining by tapped corners or cleating;

b) in turn, place each inner frame or retaining leaf into the pivot arrangement of the outer frame, holding it in the open position;

c) place the required number of springs between the base portion and the retaining leaf, locating the springs below the pivot arrangements;

d) insert display material;

e) snap the retaining leaves closed.

Whereas the prior art is adapted to display either thin membrane posters or artwork of a known, fixed depth, this invention can accommodate a wide variety of depths.

Typically this type of frame provides up to 11.5 mm of usable space which can accommodate:

a) a 10 mm board+a poser+1.5mm acrylic sheet or b) a 5 mm board+artwork with triple border+2 mm glass or c) floats between glass or acrylic sheet. or d) narrow (shallow) displays. or e) narrow (shallow) light boxes The concept of adapting a frame assembly such that the spring acts directly on the pivot region is new. This inventive feature can be applied to other types of frame and is in no way limited to types of frame described herein, which are given by way of example only.

Similarly, the concept of interposing a backing board or other load-spreading member between the spring/resilient biasing means and the surface it acts on is also new and applicable to other frames.

A further novel aspect of this invention is the use of a bow spring to keep the frame members together. A bow spring has the advantage that it simply sits on any flat surface and does not require that its two opposite ends or edges are retained in respective channels as described in the prior art.

What is claimed is:

1. A frame element assembly suitable for forming a frame of a display holder, said frame element assembly comprising a base portion and a retaining leaf, the retaining leaf being mounted to the base portion in a manner which forms a pivot, said pivot comprising a substantially convex-shaped lug and a substantially concave-shaped channel, said lug and channel being adapted such that they nest together, the channel extending around less than half the circumference of the lug, the retaining leaf being held in a pivotal arrangement by a resilient biasing means, the assembly being adapted such that, the retaining leaf can pivot between an "open" position in which a display material can be inserted or removed from the display holder and a "closed" position in which a display material is captured between the retaining leaf and the base portion so as to be retained within the display holder, wherein the resilient biasing means acts directly on a pivotal region of the retaining leaf such that the retaining leaf is demountably mounted on the base portion when the display holder is in an assembled state.

2. A frame element assembly as claimed in claim 1 wherein the resilient biasing means acts directly on a pivotal region of the retaining leaf by direct contact with the pivotal region of the retaining leaf.

3. A frame element assembly as claimed in claim 1 wherein the resilient biasing means acts on the retaining leaf through a backing board.

4. A frame element assembly as claimed in claim 1 in which the resilient biasing means comprises compressed foam board or polystyrene.

5. A frame element assembly as claimed in claim 1 in which the resilient biasing means comprises a bow spring, both ends of the bow engaging with the base portion.

6. A frame element assembly as claimed in claim 1 wherein the assembly is further adapted such that when the retaining leaf is in the closed position the leaf may be depressed against the resilient biasing means in a direction substantially towards a display material that has been positioned within the frame assembly in order to disengage the retaining leaf from the base portion.

7. A frame element assembly as claimed in claim 1 wherein the assembly is further adapted such that when the retaining leaf is in the closed position the retaining leaf may be depressed against the resilient biasing means in a direction substantially parallel to and towards the center of the frame element assembly in order to disengage the retaining leaf from the base portion.

8. A frame element assembly as claimed in claim 1 wherein the retaining leaf incorporates a protrusion which interacts with the resilient biasing means such that when the retaining leaf is opened or closed an over-center action tends to urge the retaining leaf into either the open or closed position.

9. A frame element assembly as claimed in claim 1 wherein the retaining leaf forms a "frame within a frame" surround to display material held within the frame assembly in use.

10. A frame element assembly as claimed in claim 1 wherein the resilient biasing means is retained within a channel.

11. A frame element assembly as claimed in claim 10 wherein the resilient biasing means is retained within the base portion without the necessity of the retaining leaf being present, such that on removal of the retaining leaf the resilient biasing means remains captive within the base portion.

12. A frame element assembly as claimed in claim 1, wherein the assembly is adapted to accommodate a display material backing board between the resilient biasing means and the retaining leaf.

13. A frame element assembly as claimed in claim 1 wherein the assembly further comprises a bracing channel within the base portion and a corner brace adapted to be an engaging fit within the brace channel.

14. A frame element assembly as claimed in claim 13 wherein a base of the bracing channel is aligned with an outer side edge of the base portion.

15. A frame element assembly as claimed in claim 13 wherein a front of said channel is arranged to deform against said corner brace in order to retain said corner brace in place.

16. A display holder comprising a plurality of frame element assemblies connected together in a polygonal-shape each of said frame element assemblies comprising a base portion and a retaining leaf, the retaining leaf being pivotally mounted with respect to the base portion to form a pivot, said pivot comprising a substantially convex-shaped lug and a substantially concave-shaped channel, said lug and channel being adapted such that they nest together, the channel extending around less than half the circumference of the lug, the retaining leaf being held in a pivotal arrangement by a resilient biasing means, the assembly being adapted such that, the retaining leaf can pivot between an "open" position in which display material can be inserted or removed from the display holder and a "closed" position in which display material is captured between the retaining leaf and the base portion so as to be retained within the display holder, wherein the resilient biasing means acts directly on a pivotal region of the retaining leaf such that the retaining leaf is detachably mounted with respect to the base portion when the display holder is in an assembled state.

17. A frame element assembly as claimed in claim 1 wherein the resilient biasing means acts directly on a pivotal region of the retaining leaf through a backing board.

18. A frame element assembly as claimed in claim 17 further comprising a display material, said display material being inserted on top of the backing board.

19. A frame element assembly as claimed in claim 3 further comprising a display material, said display material being inserted on top of the backing board.

20. A frame element assembly as claimed in claim 1 wherein the resilient biasing means is retained by a lug formed in the base portion.

* * * * *